US007017996B2

(12) United States Patent
Peterson

(10) Patent No.: US 7,017,996 B2
(45) Date of Patent: Mar. 28, 2006

(54) RECONFIGURABLE CHAIR

(76) Inventor: Merrill-Lee Peterson, 4635—47th Street, Sylvan Lake, Albertra (CA) T2S 1L8

( * ) Notice: Subject to any disclaimer, the term of this patent is extended or adjusted under 35 U.S.C. 154(b) by 176 days.

(21) Appl. No.: 10/619,412

(22) Filed: Jul. 16, 2003

(65) Prior Publication Data

US 2005/0012378 A1 Jan. 20, 2005

(51) Int. Cl.
*A47C 4/02* (2006.01)

(52) U.S. Cl. ..... 297/440.13; 297/195.11

(58) Field of Classification Search ..... 297/16.1, 297/195.11, 440.1, 440.12, 440.13; 248/165, 248/167, 174
See application file for complete search history.

(56) References Cited

U.S. PATENT DOCUMENTS 3,149,880 A * 9/1964 Steuer ..... 297/440.12
3,365,258 A * 1/1968 Downing ..... 312/140.2
3,766,864 A * 10/1973 Baker et al. ..... 108/162
4,025,106 A * 5/1977 Kyte ..... 297/16.1
4,334,710 A * 6/1982 Milner, Jr. ..... 297/440.22
4,648,658 A * 3/1987 Calco ..... 297/440.12
4,712,837 A * 12/1987 Swilley ..... 297/440.13
4,746,167 A 5/1988 Palmer et al.
4,971,040 A 11/1990 Gillotti
5,401,078 A 3/1995 Riach
5,605,378 A * 2/1997 Oyediran ..... 297/440.13
5,762,402 A 6/1998 Gillotti
5,971,485 A 10/1999 Clark
5,992,938 A * 11/1999 Jones ..... 297/440.13
6,065,808 A 5/2000 Tinsley
6,595,589 B1 * 7/2003 Cochran ..... 297/423.11

* cited by examiner

*Primary Examiner*—Peter R. Brown
(74) *Attorney, Agent, or Firm*—Sean W. Goodwin

(57) ABSTRACT

A portable chair which, when assembled, supports a user in the prone position and comprises inter-fitting parts allowing the chair assembly to be reconfigurable, adjustable, collapsible and easy to transport. Two side panels are pivotally connected at a straddle edge into which a seat member slidably attaches for supporting the panels in a stable splayed open position. Optional and additional support members inter-fit through corresponding openings in the side panels. Elbow and arm rests removeably attach to the side panels. The hinged connection allows the side panels to rotate between a collapsed to a parallel, closed position to the open position. The various seat member, support members and arm rests removeably attach to an inner wall of the collapsed side panels for easy transportation as one unit.

19 Claims, 7 Drawing Sheets

RECONFIGURABLE CHAIR

FIELD OF THE INVENTION

This invention relates to chairs, specifically to a modular and portable chair for supporting a user in an upright or prone position, more particularly a chair for facilitating massage therapy to forming a workstation.

BACKGROUND OF THE INVENTION

Body massage has long been done by therapists on athletes, and is now more accepted by a larger population for therapeutic and enjoyment purposes. Massage is used more and more as an approach for over all personal heath as well as for a sense of relaxation and to provide tension relief. The general concept of massage is that it requires the client to be securely supported, typically prone on a specifically configured table. This process prohibits some people from getting a massage, or determines that a massage be received at a therapist's office.

There are existing chairs used for administering massages to clients. Clients typically sit in such massage chairs in a position facing the chair so that their back, shoulders, hips and/or neck are supported and accessible to the therapist. Although most of these chairs are portable and may be taken to the client's home, office, or other location by the therapist, many are bulky and heavy to transport. Also these chairs have many parts, require adjustment once assembled, and are expensive.

One type of massage chair uses a form of tubular member for construction of the chair as described in U.S. Pat. No. 5,971,485 to Clark. It teaches a chair with angularly adjustable support struts, adjustable only after the chair is assembled, allowing the chair to accept the body conformations of children, women and men of all sizes.

A different approach is U.S. Pat. No. 4,746,167 to Palmer et al. It teaches a portable, knock-down massage chair having a hollow rectangular support base. The base also acts as a case, and while this permits storage and transport of the chair and its many parts, it is bulky. A two-panel brace assembly pivots out of a top opening of the case and is joined to a lid of the case to form a rigid triangular support assembly. A chest support and face cradle are slideably supported to the brace assembly, and an arm rest is joined to the lid panel. A seat member is secured atop side walls of the case and a leg rest is adapted to be secured within the side walls. A lateral brace must be pivoted out from the base to assist in stabilizing the chair. The brace assembly, seat and leg rest can be positioned at variable angles by the use of a number of hardware pieces, once the chair is assembled.

Yet another approach is U.S. Pat. No. 4,971,040 to Gillotti. It teaches a portable and collapsible massage chair which is not adjustable. The chair comprises an elongate upright body member with a pivotally connected leg portion. The body member carries a chest and face cushion and has a pair of side panels, with arm cushions extending outwardly from the side panels. A seat cushion and seat support member are pivotally connected to the leg portion, and extend forward through the body member side panels to present the seat cushion beneath the chest cushion. The leg portion, seat cushion, and seat support member are all moveable to be carried within the side panels and create a bulky assembly for storage and transport.

A need exists for a compact and portable massage chair that can be easily transported and stowed. Adjustability, durability and affordability are also important elements.

Accordingly, it should be quick and easy to assemble and disassemble, as well as be reconfigurable to create different seating angles. It is also desirable that the chair accept a variety of interchangeable parts and accessories.

SUMMARY OF THE INVENTION

In one embodiment, a portable chair is an assembly of two side panels and a seat member. The side panels and seat member have corresponding slots which inter-fit, the seat member acting to supportably space the side panels in an stable open position for supporting a user in a prone position. Preferably, the side panels are substantially triangular in shape. The panels are pivotally connected at a straddle edge allowing the panels to either open flat or close parallel to each other. The other two edges of the panels, each of different length, act as bases for the chair. Depending on which of the base edges are used, alternative seating angles are created, accommodating users of different size and allowing for different body positions.

Accordingly, in a broad aspect, a portable chair is adapted for support on a surface and comprises at least two side panels, each panel having at least a first base edge, adapted to engage the supporting surface, and a straddle edge. The side panels are pivotally joined at the straddle edges enabling the panels to fold between a parallel, closed position and a splayed, open position. At least a first pair of panel slots extend from the straddle edges in each panel, this pair of panel slots being aligned when the panels are in the closed position. A seat member has a pair of seat stops complementary to the first pair of panel slots so that when the panels are in the open position, the pair of seat stops slidably mate with the first pair of panel slots. The seat stops couple with the straddle edges of the panels and further support spacing the panels in the open position. A weight, such as a user or patient, is supported by the seat member which transfers the load through the side panels to a supporting surface such as a floor.

The portable chair can be assembled prior to use or during use. Assembly during use aids mobility impaired users by enabling the user to first straddle the panels and thereafter to slide the seat member into the panel slots behind the user's legs.

More preferably, each substantially triangular panel also comprises a second base edge. The first base edge and straddle edge meet to make a first seating angle, and the second base edge and straddle edge meet to make a second seating angle. The seat member and seat stops engage either first or second pairs of panel slots depending on the orientation of the straddle edge. The straddle edges of the chair are contoured for removing superfluous materials and for forming open portions at the end of the panels such as for accommodating a face rest. The straddle edges and seat members are padded. Tab and slot arrangement enable removable arm rests. Further, additional openings and slots can accommodate additional support members extending between the panels for further support of the chair. The seat member, additional support members, and arms can be removable stored on an inner wall of the panels so that when folded to the closed position the panels encase or stow these parts and allow the chair to be transported easily as one unit.

BRIEF DESCRIPTION OF THE DRAWINGS

FIG. 3*a* shows a user sitting in the chair in the first seating angle. FIG. 3*b* shows the seat member being removed. FIG. 3*c* shows the chair in a new second seating angle and indicates the seat member position. FIG. 3*d* shows a user sitting in the new second seating angle;

FIG. 4*a* is a front view of the chair, FIG. 4*b* is a top view of the chair, and FIG. 4*c* is a side view of the chair;

DETAILED DESCRIPTION OF THE PREFERRED EMBODIMENT

Figure 1A:
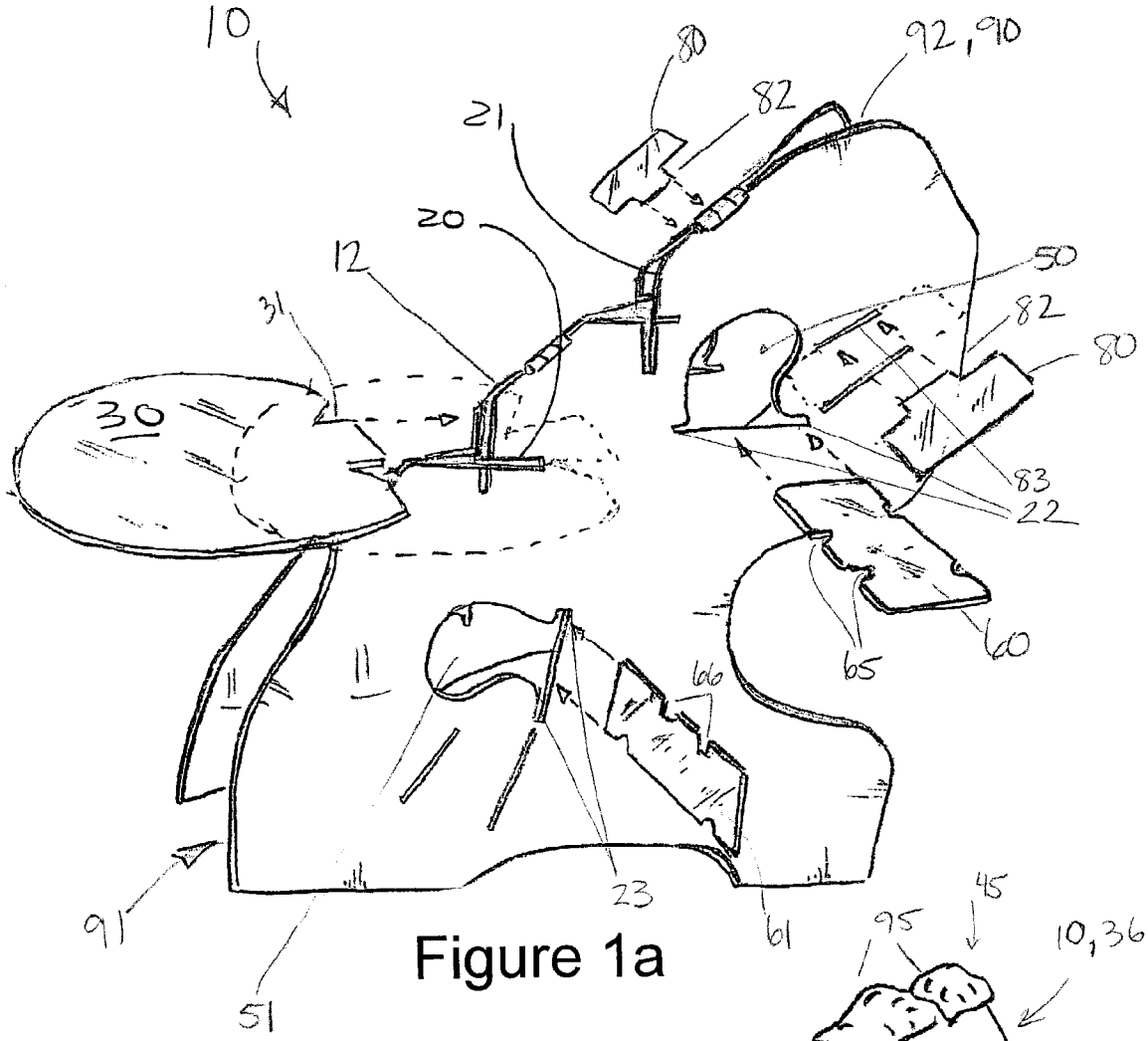
FIG. 1*a* is an exploded perspective view of one embodiment of the chair indicating the placement of the seat member, panels, and arm rests.
Figure 1B:
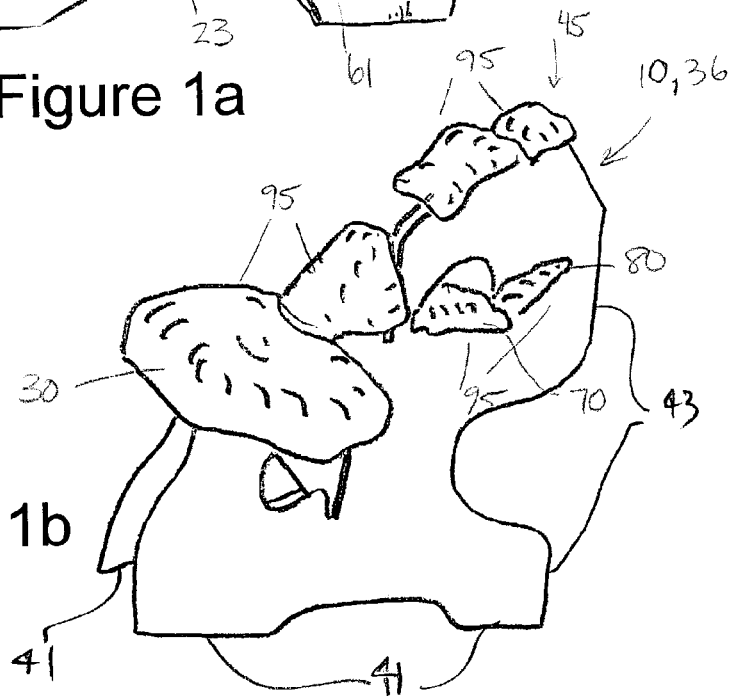
FIG. 1*b* is a perspective view of the chair in a preferred embodiment, assembled with additional support members and cushions.

With reference to FIGS. 1*a* and 1*b*, an embodiment of the invention is an assembly forming a chair 10 having detachable and inter-fitting parts for supporting a user in the upright or prone position such as for facilitating a back massage or for creating work surfaces. Herein, prone is defined as sitting and leaning face down ranging from an almost upright position to a more forward and flat position. The chair 10 comprises two side panels 11 pivotally connected at a straddle edge 12, at least a first pair of panel slots 20 extending from the straddle edge 12 of side panel 11, and a seat member 30 that inter-fits to the panel slots 20. The seat member 30 has a pair of seat stops 31 complementary to the first pair of panel slots. When the panels are in the open position, the seat stops 31 slideably mate with the first pair of panel slots, and couple with the straddle edges 12 of the side panels 11, spacing and stabilizing the side panels 11 in a stable played position. The entire weight is supported by the seat member 30 which transfers the load through the side panels 11 to a supporting surface such as a floor.

Figure 2:
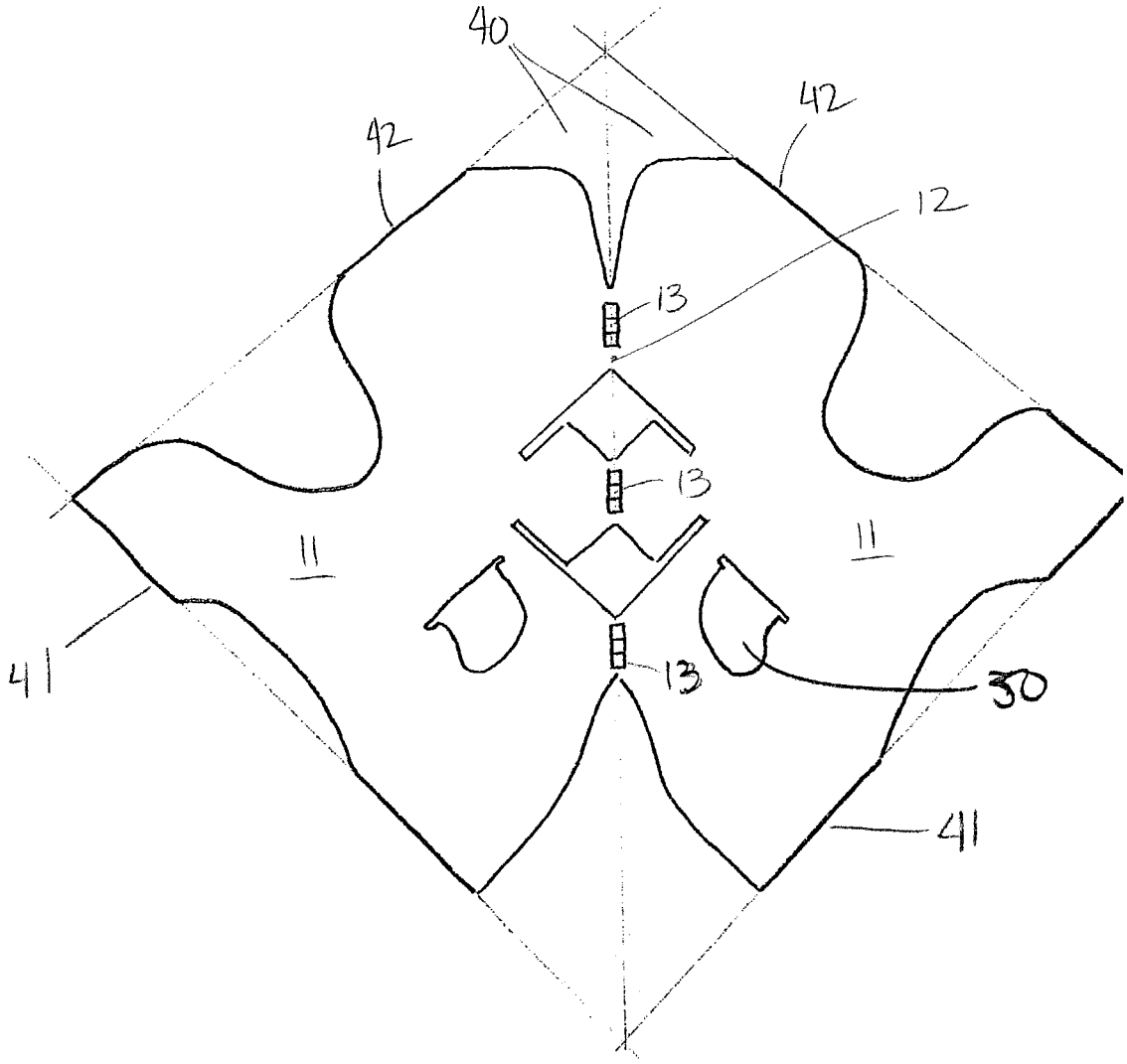
FIG. 2 is a plan view of the side panels pivoted open and lying flat. The hinged side panels are shown with a triangular envelope along with panel slots for the seat member and support openings in each side support.
Figure 4A:
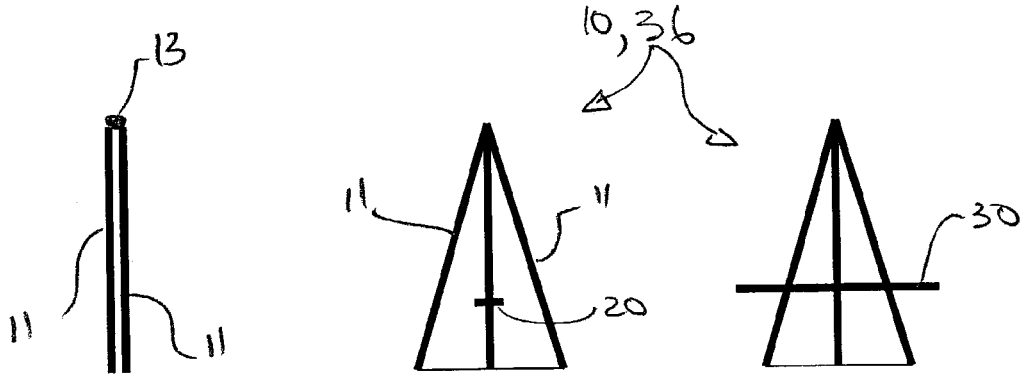
FIGS. 4*a*–4*c* are a series of front, plan and side views of the chair in stages from the closed position, open position without the seat member, and open position with the seat member.
Figure 4B:
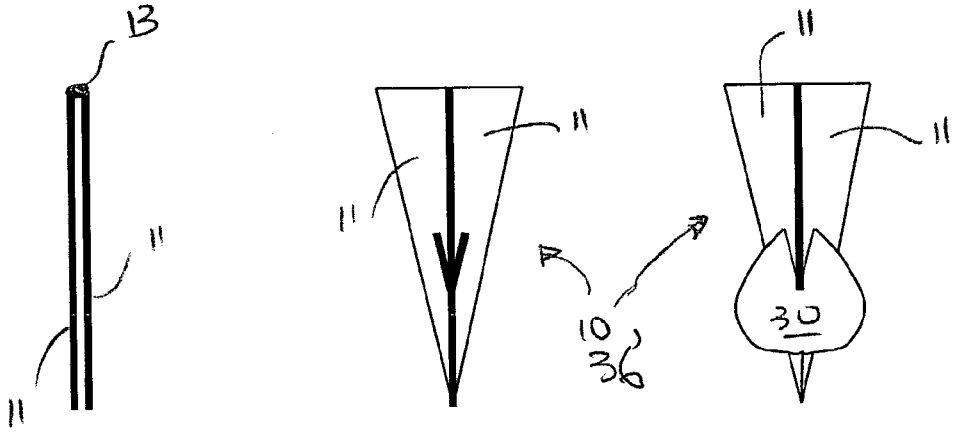
Figure 4C:
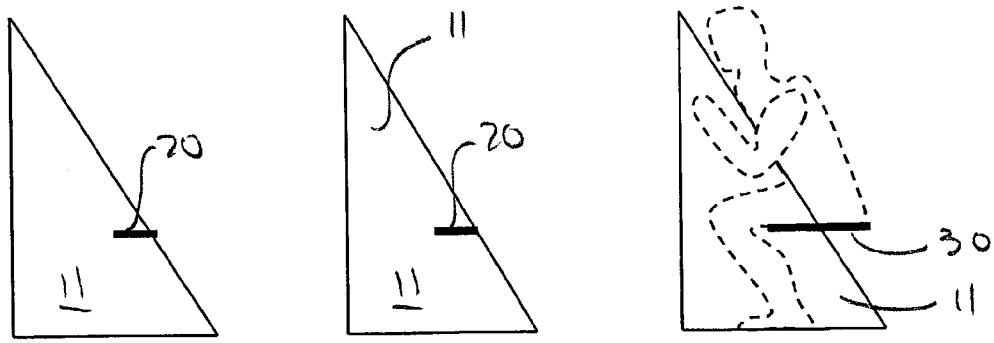
Figure 5:
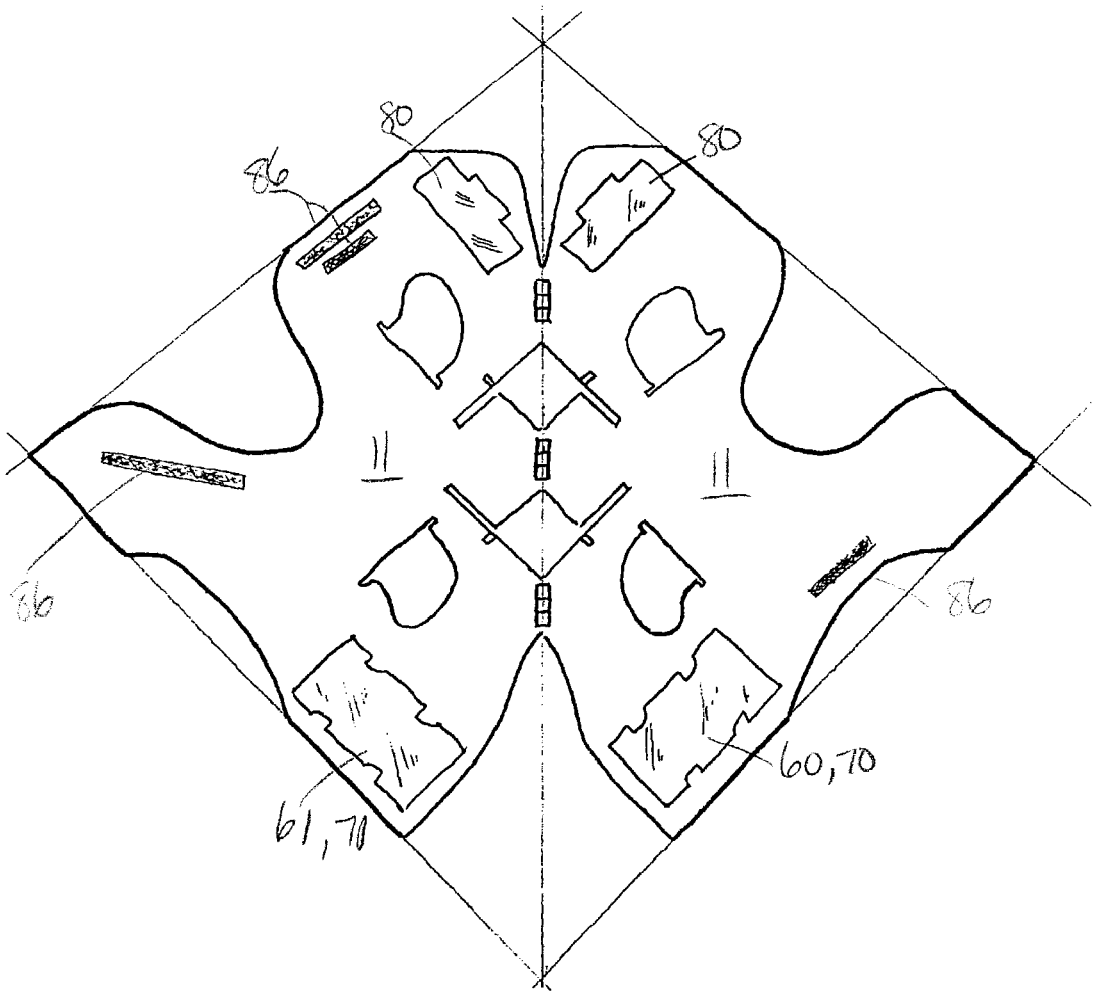
FIG. 5 is a top view of the side panels illustrating stowing arm rests, support members and the like through removable attachment with hook and loop type fasteners.
Figure 6:
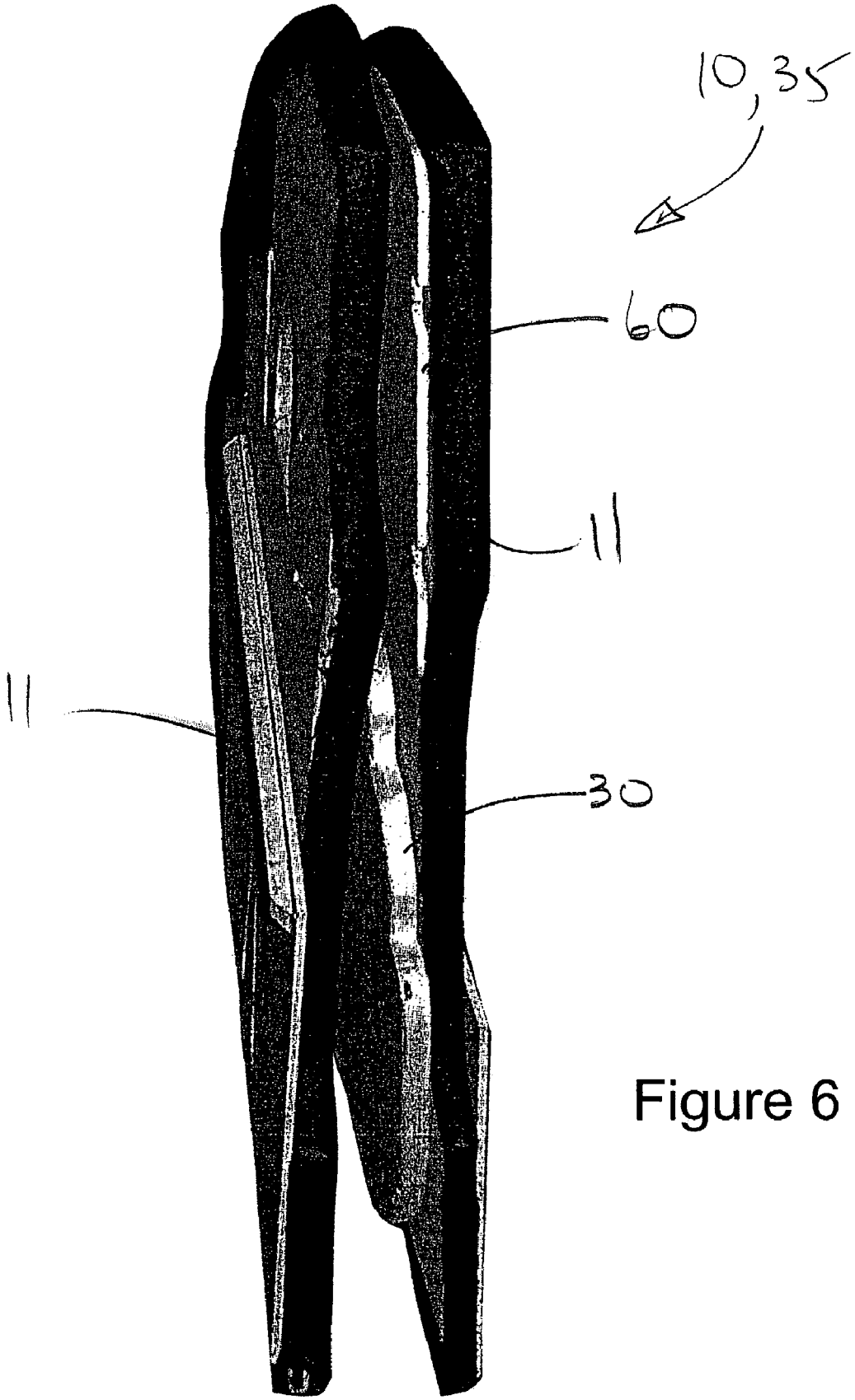
FIG. 6 is a perspective front view of closed, folded side panels sandwiching seat member and support members therebetween for transportation or storage.

As shown in FIG. 2, two side panels 11 are pivotally connected to each other through hinge mechanisms 13. The hinge mechanisms 13 permit a wide range of rotation of the side panels 11 with respect to one another. The side panels 11 fold between a parallel, closed position 35 of zero degrees (FIG. 6), a splayed, open position 36 of about 30 degrees (FIG. 4) and a flat position (FIG. 5). Each side panel 11 has a substantially triangular profile. In other words, the side panels 11 fit within a triangular envelope 40, although the three edges are not necessarily linear and thus the ends do not necessarily terminate at an apex. The two non-straddle edges of the side panels form first 41 and second base edges 42. The base edges 41, 42 are of different length creating different seating angles depending on which base edge 41, 42 is used to support the chair.

As shown in FIG. 3, the combination of the straddle edge 12 and the first base edge 41 creates a more upright, first seating angle 43 while the straddle edge 12 and second base edge 42 combination creates a more forwardly prone, second seating angle 44. The different seating angles 43, 44 ultimately accommodate users of different size or enable different applications for the chair.

Figures 3A, 3B, 3C, 3D:
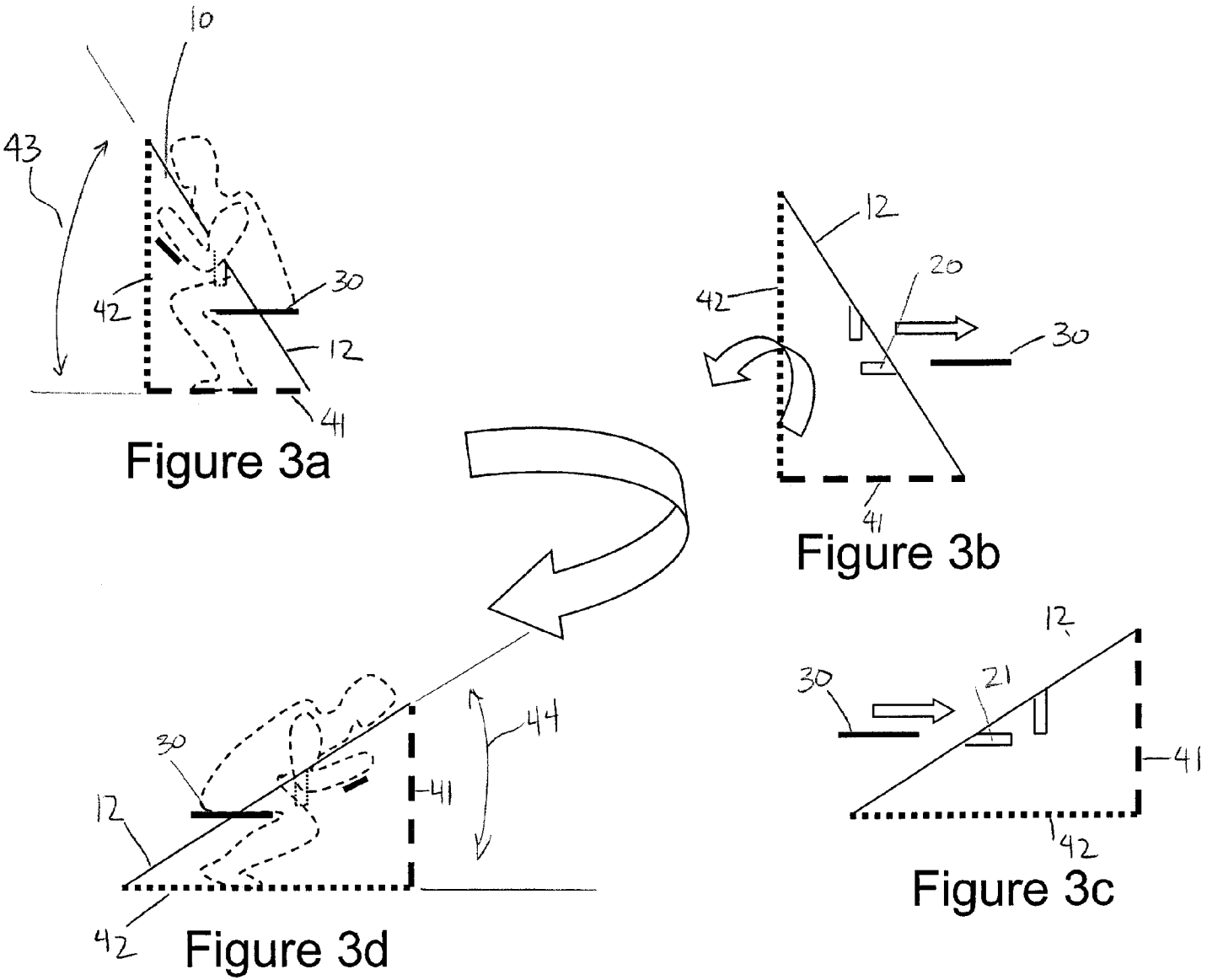
FIGS. 3*a*–3*d* is a side view schematic illustrating a series of steps for changing the seating angle of the chair.

The basic steps of assembly and positioning of the chair 10 between two seating angles are shown in FIGS. 3*a*–3*d*. First, the chair 10 is shown positioned on the first base edge 41 in a substantially upright orientation. The seat member 30 slidably mates with the first pair of panels slots 20 enabling a user to sit at the first seating angle 43 (FIG. 3*a*). To change the seating angle 43, the seat member 30 slides out (FIG. 3*b*). The chair 10 is re-positioned on the second base edge 42 and the seat stops 31 are mated with a second pair of panel slots 21 (FIG. 3*c*). The user can now sit in a more forward prone position at the second seating angle 44 (FIG. 3*d*). Note that in FIG. 3*a* or 3*d*, the seat member 30 can be mated after the user straddles the straddle edge 12, sandwiching the user between the seat member 30 and the panels 11. Assembly after the user straddles the panels 11 aids mobility impaired users by avoiding the need to lift or swing their legs over or around the seat member 30.

FIGS. 1*a* and 1*b* show the assembly of the chair 10 for one seating angle 43 or 44. The panels 11 are splayed from the closed position 35 (not shown) to the open position 36 (shown). The seat member 30 inter-fits with the first pair of panel slots 20. The first pair of panel slots 20 extend into the panels from the straddle edges 12 and are aligned with each other when the panels 11 are in the closed position 35. The seat member 30 has as pair of seat stops 31 which are complementary to the first pair of panel slots 20. When the side panels 11 are in the open position 36, the pair of seat stops 31 cooperate and slidably mate with the first pair of panel slots 20 for coupling the seat member 30 with the straddle edges 12 of the side panels 11. The seat stops 31 spaces the panels 11 in the open position 36, preventing further opening or closing of the panels 11.

The straddle edges of the chair are contoured for removing superfluous materials and for forming open portions at the end of the panels such as for accommodating an open face rest 92. The contour creates diverging portions, a first diverging portion 90 above the seat member 30, and a second diverging portion 91 below the seat member 30. The diverging portions 90, 91 alternatively provide an open face rest 92 when the chair is positioned in either seating angle 43 or 44. FIG. 2 illustrates one embodiment of the contouring of the straddle edges 12 of the chair and of the bases 41, 42.

A second pair of panel slots 21 extend from the straddle edges 12 and are preferably substantially parallel to the base edge of each panel 11. The slots are aligned with each other when the panels 11 are in the closed position 35. The seat member 30 couples with either the first or second pair of panel slots 20, 21 when the chair 10 is alternatively positioned in either the first 43 or second seating angle 44, as shown in FIG. 3*a*–3*d*.

Referring back to FIG. 1*a*, in another embodiment a first pair of openings 50 are formed in each of the side panels 11, intermediate the seat member 30 and a top 45 of the chair 10, the openings 50 being aligned when the panels 11 are in the closed position 35. A third pair of panel slots 22 extend from each opening 50. A first support member 60 having a first pair of support slots 65 inter-fits through the openings 50 and slidably mates with the third pair panel slots 22. The first support member 60 couples with the side panels 11 and further supports spacing of the side panels 11 in the open position 36. Additionally, the first support member 60 can act as a support for the user's upper limbs. For example, the first support member 60 extends beyond each side panel 11 forming an elbow rest 70, one on each side. Alternatively, the user can extend their arms through the openings 50 for more distributed arm support on the first support member 60.

Preferably, a second pair of openings 51 are formed in each of the side panels 11, intermediate the seat member 30 and the base of the chair 41. The openings 51 are strategically placed and are similar to openings 50 in that they are used when the chair 10 is supported on the alternative base edges 41 or 42, or used concurrently with openings 50. A fourth pair of panel slots 23 extend from each opening 51. A second support member 61 having a second pair of support slots 66 inter-fits through the openings 51 and slidably mates with the fourth pair panel slots 23. The second support member 61 couples with the side panels 11 and further supports spacing of the side panels 11 in the open position 36. The second support member 61 extends beyond each side panel 11 providing an alternate elbow rest 70, one on each side, when the chair is positioned in either seating angle 43 or 44.

To add further function to the chair 10, a first pair of arm rests 80, one per side panel 11 are removeably secured to the side panels 11, intermediate the seat member 30 and the top of the chair 45. A tab 82 extending from each arm rest 80 fits into one of one or more corresponding tab slots 83, at least one in each panel 11. The tab 82 frictionally engages the tab slot 83 securing the arm rests 80 in place. As shown in FIG. 7*b*, a second pair of arm rests 81 are optionally secured to the side panels 11, intermediate the seat member 30 and the base of the chair 41, 42. The second pair of arm rests 81 alternatively provide arm support or act as a leg rests 81 (FIG. 7*b*) when the chair is positioned in either seating angle 43 or 44.

With reference to FIG. 1*b*, to further facilitate use of the chair 10 for massage, cushions 95 are attached to the arm rests 80, elbow rests 70, seat member 30, along the straddle edge 12 and open face rest 92 for torso, chest and face comfort. The cushions 95 are attached with a hook and loop type fastener 86, such as VELCRO™, (not seen) for quick and easy assembly and repositioning when the seating angle 43, 44 of the chair 10 is changed.

With reference to FIG. 5, the side panels 11 can be folded open and flat. Support members 60, 61, seat member 30 (not shown), elbow rests 70, arm rests 80, and cushions 95 (not shown) are removeably attached to an inner wall 11*a* of side panels 11, such as with hook and loop type fasteners 86, for quick and easy assembly and repositioning when the panels 11 are splayed to the open position 36 and when seating angle 43, 44 of the chair 10 is changed. Shown in FIG. 6, the hinged mechanisms 13 also allow the panels 11 to fold flat for portability and can sandwich the support members 60, 61, seat member 30, elbow rests 70, arm rests 80, and cushions 95 between them, so that the panels 11 and its parts 60, 61, 30, 70, 80 and 95 can be easily stowed and transported.

Figure 7A:
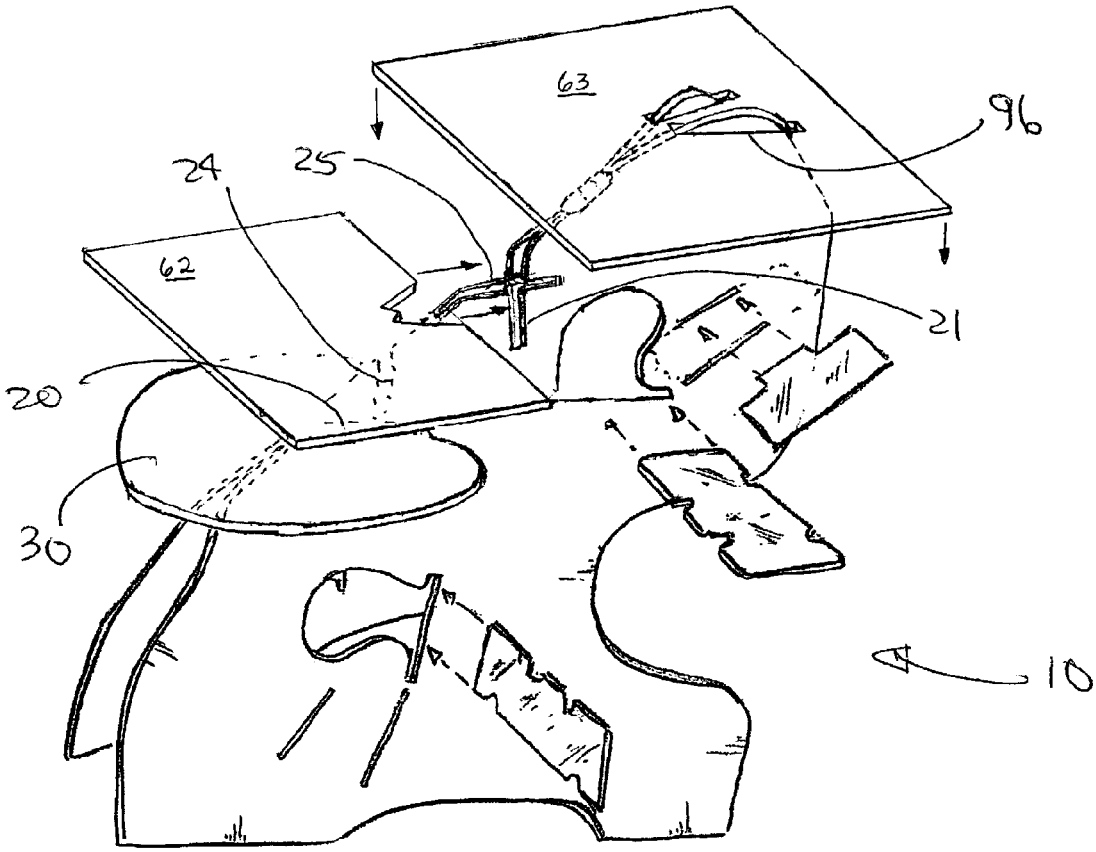
FIGS. 7*a*–7*b* are alternate embodiments of the invention, FIG. 7*a* showing additional attachments creating surfaces for uses such as a desk, shelving, or pet grooming/podium and FIG. 7*b* indicates a second pair of arm rests being used as leg rests.
Figure 7B:
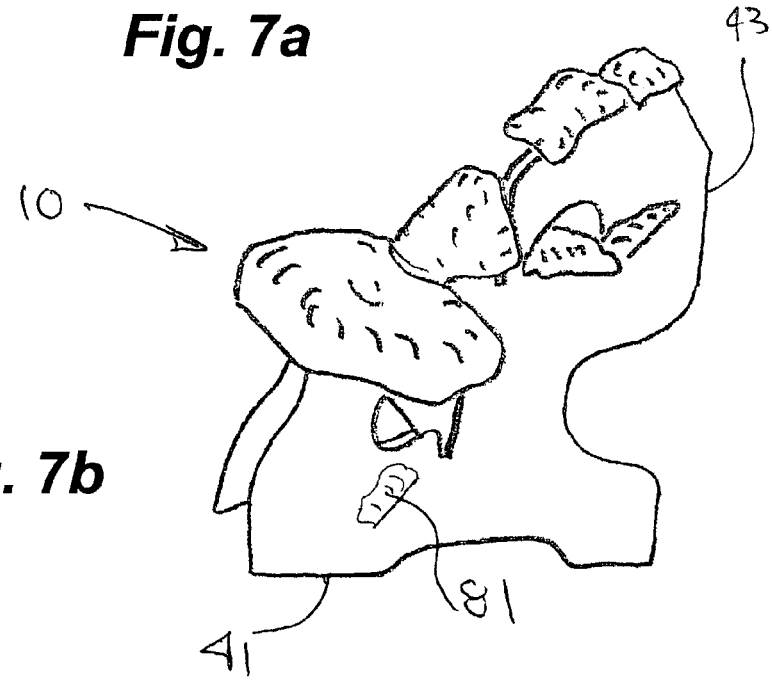

With reference to FIG. 7*a*, fifth and sixth panel slots 24, 25 extend from the straddle edges 12 of the side panels 11. The fifth and sixth panel slots 24, 25 are additional slots to allow for other embodiments of the invention, including additional surface member 62 to slidably mating with the side panels 11 when in the open position 36. For horizontal orientation of surface members 62, the additional slots 24, 25 are substantially perpendicular to and cross substantially horizontal first and second panel slots 20, 21 respectively. A second additional surface member 63 contains diverging position slots 96 which orient the surface member 63 when lowered over the side panels 11 adjacent what would be the top end 45. Surface members 62 and 63 can be used as surfaces for such things as a desk, shelf, or pet grooming station/podium. Surface members 62 and 63 can also be removeably attached to the side panels 11 for storage and transportation.

A cavity 97 is formed under the splayed panels 11 which can be used for storage when the chair 10 is in the open position 36. Use of netting or other types of closure between the side panels 11 extending between the base 41,42 not currently resting on the surface, for enabling restricted access or egress from the cavity 97. Examples of uses for other embodiments include such things as a desk, shelf, or pet grooming station or podium.

The embodiments of the invention in which an exclusive property or privilege is being claimed are detailed as follows:

1. A portable chair assembly adapted for support on a surface comprising:

at least two side panels, each panel having at least a first base edge adapted to engage the supporting surface and a straddle edge, the panels being pivotally joined at the straddle edges enabling the panels to fold between a parallel, closed position and a splayed, open position;

at least a first pair of panel slots extending from the straddle edges in each panel, the first pair of panel slots being aligned when the panels are in the closed position; and a seat member having a pair of seat stops complementary to the first pair of panel slots so that when the panels are in the open position, the pair of seat stops slidably mate with the first pair of panel slots for coupling the seat member with the straddle edges of the panels, the seat member further supportably spacing the panels in the open position, wherein a weight is supported by the seat member; and wherein the straddle edges are contoured for forming diverging edge portions when the side panels are in the open position.

2. The portable chair of claim 1 wherein the two side panels further comprise:

a second base edge wherein each panel forms a substantially triangular envelope, the first base edge and straddle edge intersect at a first seating angle and the second base edge and straddle edge intersect at a second seating angle;

a second pair of panel slots extending from the straddle edges in each panel, the second pair of panel slots being aligned when the panels are in the closed position; wherein the portable chair is operable to alternatively engage the supporting surface on one of either base edges for orienting the straddle edge between one of either seating angles, and wherein the seat member is coupled with either the first or second pair of panel slots respectively.

3. The portable chair of claim 2 further comprising:

at least a first pair of openings formed in each of the side panels, intermediate the seat member and a top of the chair, the openings being aligned when the panels are in the closed position;

a third pair of panel slots extending from each opening; and at least a first support member having a first pair of support slots so that when the panels are in the open position, the first pair of support slots slidably mate with the third pair of panel slots for coupling the support member with the side panels for further supportably spacing the side panels in the open position.

4. The portable chair of claim 3 where the first support member extends beyond each side panel and forms an elbow rest.

5. The portable chair of claim 3 further comprising:

a second pair of openings formed in each of the side panels, intermediate the seat member and a base of the chair, the openings being aligned when the panels are in the closed position, a fourth pair of panel slots extending from each opening, and a second support member having a second pair of support slots, so that when the panels are in the open position, the second pair of support slots slidably mate with the fourth pair of panel slots for coupling the support member with the panels for further supportably spacing the side panels in the open position.

6. The portable chair of claim 5 further comprising:

at least a first pair of rests, one per panel; and means for removeably securing the first pair of rests to the side panels intermediate the top of the chair and the seat member when the chair is positioned at the first seating angle.

7. The portable chair of claim 6 wherein the means for removeably securing each first pair of rests to each panel comprises:

a tab extending from each of the first pair of rests; and a tab slot in the panel for receiving the tab, the tab frictionally engaging the tab slot.

8. The portable chair of claim 6 further comprising a second pair of rests, one rest per panel for alternatively securing the second pair of rests to the side panels intermediate the base of the chair and the seat member when the chair is at the second seating angle.

9. The portable chair of claim 6 wherein the seat member, elbow rests, and pairs of rests are removeably attached to the side panels when the panels are folded to a closed position for facilitating portability.

10. The portable chair of claim 6 wherein the seat member, elbow rests, and pairs of rests are removeably attached with a hook and loop type fasteners.

11. The portable chair of claim 5 further comprising a fifth and sixth pair of panel slots extending from the straddle edges of the side panels, but running perpendicular to and crossing the first and second pairs of panel slots, respectively.

12. The portable chair of claim 11 having a kit of one or more additional attachments such as at least one additional surface member that removeably mates with the fifth and sixth pair of panel slots.

13. The portable chair of claim 2 wherein at least a first diverging portion is formed at one end of the side panels for forming an open face rest; and further comprising:

a second diverging portion at the other end of the side panels to alternatively provide another open face when the chair is positioned at either second seating angle and, wherein a series of cushions removeably attach along the straddle edge to comfortably support a torso, chest and a face.

14. The portable chair of claim 1 where the side panels are pivotally connected with at least one hinge type mechanism.

15. The portable chair of claim 1 wherein at least a first diverging portion is formed at one end of the side panels for forming an open face rest.

16. A method for supporting a user for a massage comprising:

providing a seat member and at least two side panels pivotally joined at a straddle edge and each panel further comprising a base edge, the seat member being releasably coupled with the side panels so that when coupled, the seat member spaces the panels in a splayed position;

opening the panels to the splayed position, supported on each panel's base edge; and mating the seat member with the straddle edges of the panels, the seat member supportably spacing the panels in the open position so as to be adapted for supporting the user straddling the straddle edge in a prone position, wherein the weight of the user is supported by the seat member.

17. A portable chair assembly adapted for support on a surface comprising:

at least two side panels, each panel having at least a first base edge adapted to engage the supporting surface;

a straddle edge extending at an acute angle relative to the base edge, the straddle edge pivotally connecting the at least two side panels for enabling the panels to fold between a parallel, closed position and a splayed, open position;

at least a first pair of panel slots extending from the straddle edges in each panel, the first pair of panel slots being aligned when the panels are in the closed position; and a seat member having a pair of seat stops complementary to the first pair of panel slots so that when the panels are in the open position, the pair of seat stops slidably mate with the first pair of panel slots for coupling the seat member with the straddle edge of the panels, the seat member further supportably spacing the panels in the open position, wherein a weight is supported by the seat member.

18. The portable chair assembly of claim 17 further comprising:

a second base edge wherein each panel forms a substantially triangular envelope, the first base edge and straddle edge intersect at a first seating angle and the second base edge and straddle edge intersect at a second seating angle; and a second pair of panel slots extending from the straddle edges in each panel, the second pair of panel slots being aligned when the panels are in the closed position; wherein the portable chair is operably adapted to alternatively engage the supporting surface on one of either a first or second base edge for orienting the straddle edge between one of either seating angles, and wherein the seat member is coupled with either the first or second pair of panel slots respectively.

19. The portable chair assembly of claim 18 further comprising:

at least a first pair of openings formed in each of the side panels, intermediate the seat member and a top of the chair, the openings being aligned when the panels are in the closed position;

at least a third pair of panel slots extending from each opening; and at least a first support member having a first pair of support slots so that when the panels are in the open position, the first pair of support slots slidably mate with the at least a third pair of panel slots for coupling the support member with the side panels for further supportably spacing the side panels in the open position.

* * * * *